United States Patent [19]

Erickson

[11] 4,292,011

[45] Sep. 29, 1981

[54] TURBO PUMP GAS COMPRESSOR

[75] Inventor: John W. Erickson, Huntington Beach, Calif.

[73] Assignee: Kobe, Inc., City of Commerce, Calif.

[21] Appl. No.: 68,138

[22] Filed: Aug. 20, 1979

[51] Int. Cl.[3] ..... F04B 23/04

[52] U.S. Cl. ..... 417/53; 417/88; 417/247; 417/391; 417/405

[58] Field of Search ..... 417/391, 247, 405, 406, 417/408, 88, 53; 415/501

[56] References Cited

U.S. PATENT DOCUMENTS

| | | | |
|---|---|---|---|
| 1,610,454 | 12/1926 | Lawaczeck | 417/406 |
| 2,022,781 | 12/1935 | Pigott | 417/247 |
| 4,003,678 | 1/1977 | David | 417/405 |

*Primary Examiner*—Michael Koczo, Jr.
*Attorney, Agent, or Firm*—William C. Norvell, Jr.

[57] ABSTRACT

An improved power fluid driven turbo pump is provided for pumping oil wells of the type having, from time-to-time, significant quantities of gas included in the oil so that wide variations in the density of the medium to be pumped may be expected to be encountered. Two separate pumping units driven by the same power fluid are employed, one of which is designed to efficiently compress and pump gas, and the other is designed to efficiently pump normal density fluids. Since the pumps are disposed in series, the combined efficiency of the pumps is substantially unchanged due to changes in density of the fluid to be pumped and remains at a uniformly high level.

5 Claims, 2 Drawing Figures

TURBO PUMP GAS COMPRESSOR

BACKGROUND OF THE INVENTION

1. Field of the Invention

The invention relates to turbine driven pumps of the type employed to pump fluid from oil wells, particularly oil wells containing significant amounts of gas in the fluid to be pumped.

2. Description of the Prior Art

Turbine driven pumps have long been employed for the pumping of oil wells through the utilization of the energy transmitted to the bottom of the well by a pressurized power fluid produced at the well head. In prior art units, the turbine section of the pump was necessarily designed to operate at a compromise efficiency in order to permit a substantial increase in speed of the turbine when the density of the fluid to be pumped decreased sharply due to the presence of gas. For example, the turbine and pump would be designed to accommodate a speed increase on the order of eight to one which would be produced by a density reduction on the order of sixty-four to one when a substantial amount of gas was present in the pumping fluid. While the efficiency under these gassy conditions is acceptable, being on the order of forty percent, the majority of the operation of the pump when little gas is present is at a much lower efficiency, for example less than thirty percent. The undersirability of operating the pump for long periods of time at such a low efficiency is self-evident.

SUMMARY OF THE INVENTION

This invention contemplates overcoming the limited efficiency of a turbo driven pump required to pump both high density and low density gaseous fluids by replacing such pump with two pumping units, each of which is driven by a separate turbine, and wherein the one pumping unit is designed to efficiently pump high density fluid at a restricted speed and the other pump unit is designed to efficiently pump gas or low density fluid at a significantly higher speed than the one pump.

DESCRIPTION OF THE PREFERRED EMBODIMENTS

Figure 2:
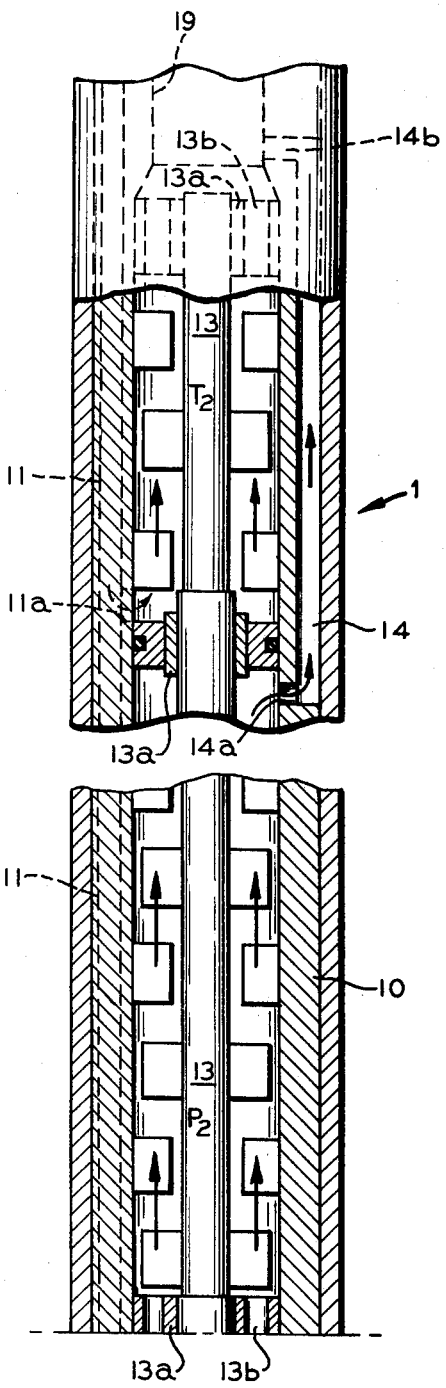
FIG. 2 is a view similar to FIG. 1 of the upper portion of the apparatus.
Figure 1:
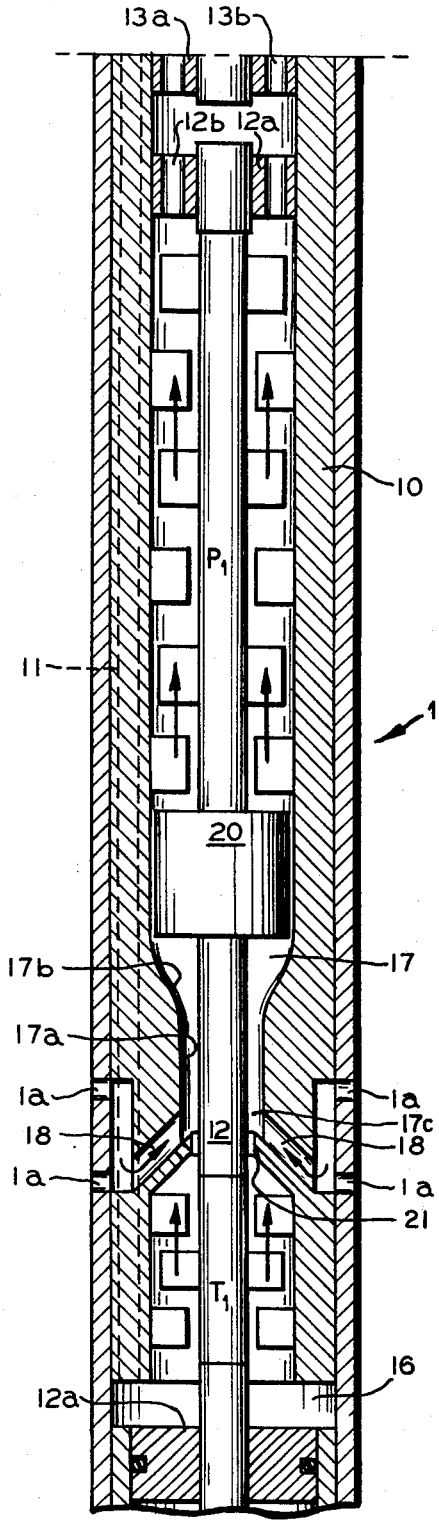
FIG. 1 represents a schematic vertical sectional view of the lower portion of a fluid driven pumping apparatus for oil wells constructed in accordance with this invention.

Referring to FIGS. 1 and 2, the numeral 1 represents a conventional bottom hole assembly communicating to the production zone of the well and having open ports 1*a* provided in the side wall of the bottom hole assembly 1. In the bottom portions of the bottom hole assembly 1, a housing 10 containing a pumping apparatus in accordance with this invention is inserted.

The housing 10 provides mountings for two conventional turbo driven pumping units, the turbine of the one unit being schematically indicated at T1 and the pump of the same unit being schematically indicated at P1. The turbine of the second unit is schematically indicated at T2 while the pump of such unit is schematically indicated at P2.

One or more downwardly extending power fluid conduits 11 are provided which can be integrally formed in the housing 10 or can comprise a separate length of tubing if the diametrical constraints of the well permit. In any event, the conduit 11 provides a passage from a source of pressurized power fluid at the well head to a chamber 16 in the bottom portion of the well from which the power fluid flows upwardly into the inlet of the turbine T1. The rotor of the turbine T1 is secured to an upwardly extending shaft 12. The shaft 12 is supported by a plurality of conventional bearings 12*a* disposed along the length of the housing 10. At an axially spaced location above the turbine T1, the pump unit P1 is mounted and the rotor of such pump unit is driven by the shaft 12.

Above the pump unit P1, a second upwardly extending axial shaft 13 is provided, being mounted in a plurality of axially spaced bearings 13*a* provided in housing 10. The second pump unit P2 has its rotor secured to the lower portions of shaft 13 and the rotor of the turbine unit T2 is secured to the upper portions of shaft 13. The turbine T2 is energized by power fluid supplied through the power fluid conduit 11 through radial passage 11*a* which diverts a portion of the power fluid into the inlet of the turbine T2.

Between the upper end of the turbine unit T1 and the lower end of the pump unit P1, an annular chamber 17 is defined between the housing 10 and the shaft 12. Those skilled in the art will recognize that while the housing 10 is schematically represented as being a single member, it will undoubtedly be constructed of a plurality of axially abutting or threadably united sections to facilitate the construction of the various passages in the housing 10 which will be hereinafter described.

A plurality of angularly upwardly directed ports 18 are provided in the housing 10 which permit well fluids to pass through the casing apertures 1*a* and into an annular passage 17*a* defined between the inner wall of the chamber 17 and the shaft 12.

A jet pump action is provided by the discharge flow from the turbine T1 and is accelerated through the annular nozzle 21 into suction region 17*c* where it induces flow of well fluids into the pump. The turbine discharge and well production are mixed in the jet pump region 17*a* and diffused in region 17*b*, recovering the velocity energy imparted to the fluid by the nozzle 21. The jet pump provides an initial pressure increase to the well fluid.

A conventional inducer element 20 is mounted in the top portions of the chamber 17 so as to increase the pressure of the two axially moving fluid streams that are introduced into the lower portions 17*c* of the chamber 17 into a stream suitable for supplying the inlet of the rotary pump P1.

It should be further noted that the power fluid supplied to the turbine T1 from the chamber 16 also passes upwardly through the nozzle 21 into the annular passage 17*a* when it is discharged from the turbine T1. Although the majority of energy in this power fluid has been consumed by the turbine T1, the fluid still has a significant component of axial velocity and this is employed, in conjunction with the diffuser section 17*b*, to impart a pressurizing action on the well fluids entering the inclined ports 18.

The pressurized fluid output of the pump P1 flows axially directly into the input end of pump P2. The intermediate bearings 12*a* and 13*a* are provided with suitable axially extending conduits 12*b* and 13*b* to permit such fluid flow. Thus, in effect, the well fluids are accelerated in the jet pump by the spent power fluid discharged by the turbine T1, intimately mixed and pressurized with the power fluid by the inducer 20 and subjected to the pumping action of the pump P1 to effectively super-charge such fluid so that the density thereof, despite the presence of a substantial gas content, is significantly increased above the density of the well fluid entering the casing 1. The pump P1 is designed to operate at a higher speed ratio between light and heavy fluids that will provide efficient compression of the high gas content fluid supplied to it over a substantial density range. In contrast, the pump P2, which is separately driven by the shaft 13 and the turbine T2, is designed to operate at a lower speed ratio that will yield optimum efficiencies for the pre-compressed or super-charged fluid supplied to its inlet from the outlet of pump P1.

The pressurized fluid output of the pump P2 is diverted through a plurality of radial ports 14*a* provided in the housing 10 into one or more axially extending conduits 14 formed in the wall of the housing 10 so as to flow upwardly around the elements of the turbine unit T2, and thence back into a central axial conduit 19 in the housing 10 through a plurality of radially disposed ports 14*b*. The central axial conduit 19 is then conventionally connected to a production string (not shown) extending to the top of the well.

With the described construction, each of the turbo pump units T1 - P1 and T2 - P2 can have their blading designed to provide optimum operation for the fluid densities supplied thereto and, more importantly, can operate at substantially different speed ratios. In a typical example, the turbine pump unit T1 - P1 will be designed to be capable of operating over a speed range of four to one to accommodate a fluid density range of sixteen to one. This operating speed range permits a substantial degree of pre-compression or super-charging of high gaseous content fluid supplied to the turbo pump unit T1 - P1 and provides the fluid inlet to turbo pump unit T2 - P2 with a significantly increased density fluid so that this pump can operate at much lower speed ratios at the best efficiency point for the turbine T2 and the pump P2. For example, a pumping apparatus incorporating this invention will be able to operate at an efficiency of forty-five percent under no gas conditions, and forty-eight percent when significant amounts of gas are contained in the well fluid.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for pumping an oil well having wide variations of density in fluids to be pumped due to gas content, comprising, in combination: a source of pressurized power fluid; means for conducting said power fluid to the bottom portion of the well; a first turbo driven pump disposed in the bottom portion of the well and having the turbine thereof driven by said power fluid; a second turbo driven pump disposed axially adjacent said first pump and having its turbine driven by said power fluid; first conduit means for conducting well fluids to an inlet of said first pump; means disposed in said first conduit means for intermingling of the spent power fluid emerging from the turbine of said first pump with the well fluid in said first conduit, thereby producing an initial pressurizing of the fluid to the inlet of said first pump; means disposed in said first conduit between said intermingling means and the inlet of said first pump for increasing the pressurization of the intermingled fluids; second conduit means connecting an outlet of said first pump to an inlet of said second pump; and third conduit means for connecting an outlet of said second pump to the well head, whereby said first pump can be designed to efficiently pump low density fluid at relatively high shaft speeds and said second pump can be designed to efficiently pump the discharge of said first pump at shaft speeds substantially lower than the shaft speed of said first pump.

2. The apparatus defined in claim 1 wherein said intermingling means includes a venturi-shaped passageway for producing a pumping action on the inflowing well fluid by the spent power fluid.

3. A method for pumping an oil well having wide variations of density in fluids to be pumped due to gas content comprising the steps of: (a) disposing a plurality of turbo driven pumping units in the bottom portion of the well in axially stacked relationship; (b) driving the turbine portion of each of said turbo driven pumping units by pressurized fluid supplied from the well head; (c) supplying well fluids to the inlet end of one pumping unit; (d) intermingling the fluid leaving the turbine of said one pumping unit and said well fluid for initially pressurizing the intermingled fluids; (e) further pressurizing the intermingled fluids prior to supplying them to the inlet end of said one pumping unit; and (f) supplying fluids discharged from the outlet of said one pumping unit to the inlet end of another pumping unit, whereby said one pumping unit operates at substantially higher shaft speeds than the other said pumping unit due to the substantial difference of density of fluid supplied to the respective inlets of the said two pumping units.

4. A method for pumping an oil well having wide variations of density in fluids to be pumped due to gas content comprising the steps of: (a) disposing two turbo driven pumping units in the bottom portion of the well in axially stacked relationship; (b) driving the turbine portion of each of said turbo driven pumping units by pressurized fluid supplied from the well head; (c) supplying well fluids to the inlet end of one pumping unit; (d) intermingling the fluid leaving the turbine of said one pumping unit and said well fluid supplied to the inlet end of said one pumping unit for initially pressurizing the intermingled fluids; (e) further pressurizing the intermingled fluids prior to supplying them to the inlet end of said one pumping unit; and (f) supplying fluids discharged from the outlet of said one pumping unit to the inlet end of the other pumping unit, whereby said one pumping unit operates at substantially higher shaft speeds than the other pumping unit due to the substantial difference of density of fluid supplied to the respective inlets of the two pumping units.

5. The apparatus defined in claim 1 wherein said means for increasing the pressurization of the intermingled fluids comprises an inducer element.

* * * * *